US005881938A

United States Patent [19]

Wakefield

[11] Patent Number: 5,881,938

[45] Date of Patent: Mar. 16, 1999

[54] COMBINED GRIP PLATE AND CONCEALABLE HANDGUN CARRIER

[75] Inventor: James T. Wakefield, Palmdale, Calif.

[73] Assignee: D.E.F.S. Inc., Las Vegas, Nev.

[21] Appl. No.: 926,459

[22] Filed: Sep. 10, 1997

[51] Int. Cl.[6] ..... A45C 1/04

[52] U.S. Cl. ..... 224/587; 224/192; 224/665; 224/666; 224/667; 224/271; 224/912

[58] Field of Search ..... 224/192, 193, 224/198, 243, 255, 269, 271, 576, 587, 665, 666, 667, 911, 912; 24/3.1, 563

[56] References Cited

U.S. PATENT DOCUMENTS

| | | | |
|---|---|---|---|
| 2,320,450 | 6/1943 | Valenzuela | 224/271 |
| 4,056,218 | 11/1977 | Barna | 224/255 |
| 4,667,374 | 5/1987 | Bianchi | 224/667 |
| 5,630,535 | 5/1997 | Valenti | 224/269 |

*Primary Examiner*—David J. Walczak
*Assistant Examiner*—Timothy L. Maust

[57] ABSTRACT

A unibody, combination grip plate and appendage fastening means constructed in such a manner so as to be received at the frame of a handgun. The unibody grip plate and appendage fastening means is affixed to the handle of a handgun; the appendage fastening means portion, which is camouflaged and concealable behind a user's wearing apparel, lifts and moves independently away from the grip plate portion permitting Total Weapon Concealment (TWC) of a handgun inside the waistband (IWB) between the user's torso and trouser, or other wearing apparel) completely below the belt line (BBL). A handgun that is equipped with the principal object can be placed IWB in a comfortable and secure fashion. The appendage fastening means facilitates TWC of a handgun BBL, yet the principal object allows a person who is covertly carrying a handgun fingertip access and immediate use.

8 Claims, 8 Drawing Sheets

COMBINED GRIP PLATE AND CONCEALABLE HANDGUN CARRIER

CROSS-REFERENCE TO RELATED APPLICATIONS

Not Applicable

REFERENCE TO A MICROFICHE APPENDIX

Not Applicable

BACKGROUND OF THE INVENTION

1. Field of Invention

This invention relates in general to holsters and handgun handgrips, but in particular to a handgun grip that provides a means of securing a concealable handgun inside the waistband (IWB) in a covert manner.

2. Description of the Prior Art

The principal object is a device that is designed to facilitate the complete concealment of a handgun, upon ones person, IWB. For the purposes of this writing, complete concealment shall mean that a handgun being carried upon ones person is not visible to the casual observer. Furthermore, said handgun totally hidden from view is undetectable whether or not the user is wearing a coat or some other type of outer garment to cover it. Civilians, law enforcement officers, and military personnel possess and use handguns as a result of personal choice, occupational specialty, or necessity. Most often, when a handgun is desployed, it is carried or transported by means of a pistol case, or as it is commonly referred to: a holster. Traditionally constructed holsters tend to be objects that are visible when in use and are generally attached or affixed to wearing apparel, or some portion of the torso.

The concept of carrying a handgun concealed upon ones person is certainly not a novel one. However, given the current rise in popularity of compact handguns and the technological advancements that have been made in the quality of compact autoloading handguns an improved method of concealment is warranted. The principal object eliminates the need for a holster, but at the same time, it provides a comfortable and safe method for carrying a handgun IWB.

There are times when the overall usefulness of a handgun can be greatly enhanced by ones ability to render it totally hidden from view and concealed on the body. Three examples of that are: 1) an armed on-duty plain clothes police officer; 2) a police officer, who is off-duty and that has chosen to arm himself or herself while dressed in civilian attire; and 3) a person that is licensed to carry a handgun and that chooses to keep a handgun concealed upon his or her person.

The previous state of the art, for IWB methods of concealing a handgun, include but is not limited to: The Barami, "Hip-Grip"™, handgun handle-holster, and the Kel-Tec™ CNC Inc., "Belt Clip," frame mounted clip. Both of the aforementioned devices offer a high level of quality in construction and design, and both are superbly crafted after market items; nevertheless, what each of the aforementioned devices lack is the ability to completely conceal a handgun, IWB. The principal object, herein referred to, can completely conceal a handgun IWB and below the belt line ("BBL").

The Barami device is comprised of two wooden grip plates and is designed specifically for revolvers; it secures a revolver, IWB, by means of a carrying device that is located at the upper portion of the revolvers handle, and extends over the frame by the hammer and the cylinder. A revolver that is equipped with the Barami utility, though partially concealable, can still be seen by a casual observer when in the waistband at the hip area. The principal object has its carrier appendage and fastening means located on the lower end of a handgun's handle. By placing the principal object's fastening means at the lower part of a handgun's handle, it results in concealment of all of the handgun, not just a major portion of it. Drawing reference now to the Kel-Tec device, it is constructed of metallic materials and is designed to be attached exclusively to a Kel-Tec brand weapon, thus limiting it from universal application. The Kel-Tec device attaches its "belt clip carrier" on the frame of a Kel-Tec handgun not on the handgun's handle. When in use the the Kel-Tec frame application causes a portion of the handgun's handle to remain above the waistband, exposed to view. The Kel-Tec and Barami devices do not render all portions of a handgun, concealed when IWB. The principal object, which can be constructed of thermoplastic materials, renders a handgun completely concealed when IWB. The principal object is designed for compact handguns with caliber sizes ranging from .22 to .45; and, it can be used with various brands of compact handguns; it is not restricted to a certain brand, model, caliber or type of handgun In an armed encounter, conditions may exist wherein the total concealment of a handgun would present a distinct tactical advantage over a handgun that is visible and being carried in a holster. A tactical disadvantage would certainly exist when a handgun is only partially concealed on the body and the weapon is clearly visible. Ones ability to produce and subsequently use a handgun, which has gone unnoticed, and that is concealed from view, until it is needed, could be the difference between life and death in a live fire scenario.

The principal object can render a handgun TOTALLY concealed upon ones torso IWB; it does so by means of a unibody grip plate and accompanying appendage. The principal object does not extend beyond the outermost edges of the handgun handle, nor does it create an extension beyond the dimensions of the factory installed grips; it can be applied to a vast number of compact handguns that are currently sold on the open market. The principal object offers, and subsequently provides, the user with a significant tactical edge over other IWB technologies: Total Weapon Concealment (TWC). Concealment of a handgun, IWB, can be prolonged significantly when the user of the invention is wearing a shirt, or similar garment, and then blouses the article of clothing above the trousers, directly over the point where the primary object's fastening means is affixed to the waist band. The principal object is one that is efficiently used in conjunction with various types of apparel which are worn on a daily basis, such as: trousers, pants, slacks, shorts, belts, and shirts. When the principal object is in use, it does not cause a handgun to have a readily distinguishable outline or signature. In addition, the principal object can be adapted for use with any of the following list of items: purses, brief cases, containers, furniture, motor vehicles and any locality that a concealable handgun can be placed or stored in.

It is a goal of the principal object to provide a firearm that is equipped with it, and that is carried IWB, the same level of security that one can expect from a holster; however, the principal object can provide that level of security without a traditionally constructed case or pouch. The principal object does not require the machining of the handgun itself. The principal object is one that is designed to be affixed at the most rearward portion of a handgun handle and on the lower end of the frame. Said placement of the device makes it easily adaptable to a vast array of concealable handguns. When properly attached to the torso IWB, the user of the principal object need not concern himself or herself with the question of whether or not the handgun can be detected by the casual observer. A handgun that is equipped with the invention can be secreted in a covert fashion below the waistline and at the same time provide a maximum level of handgun security to the user. The advantages of the principal object will become increasingly apparent after a thorough review of the drawings that illustrate the invention's specifications.

DETAILED DESCRIPTION OF THE INVENTION

Figure 1:
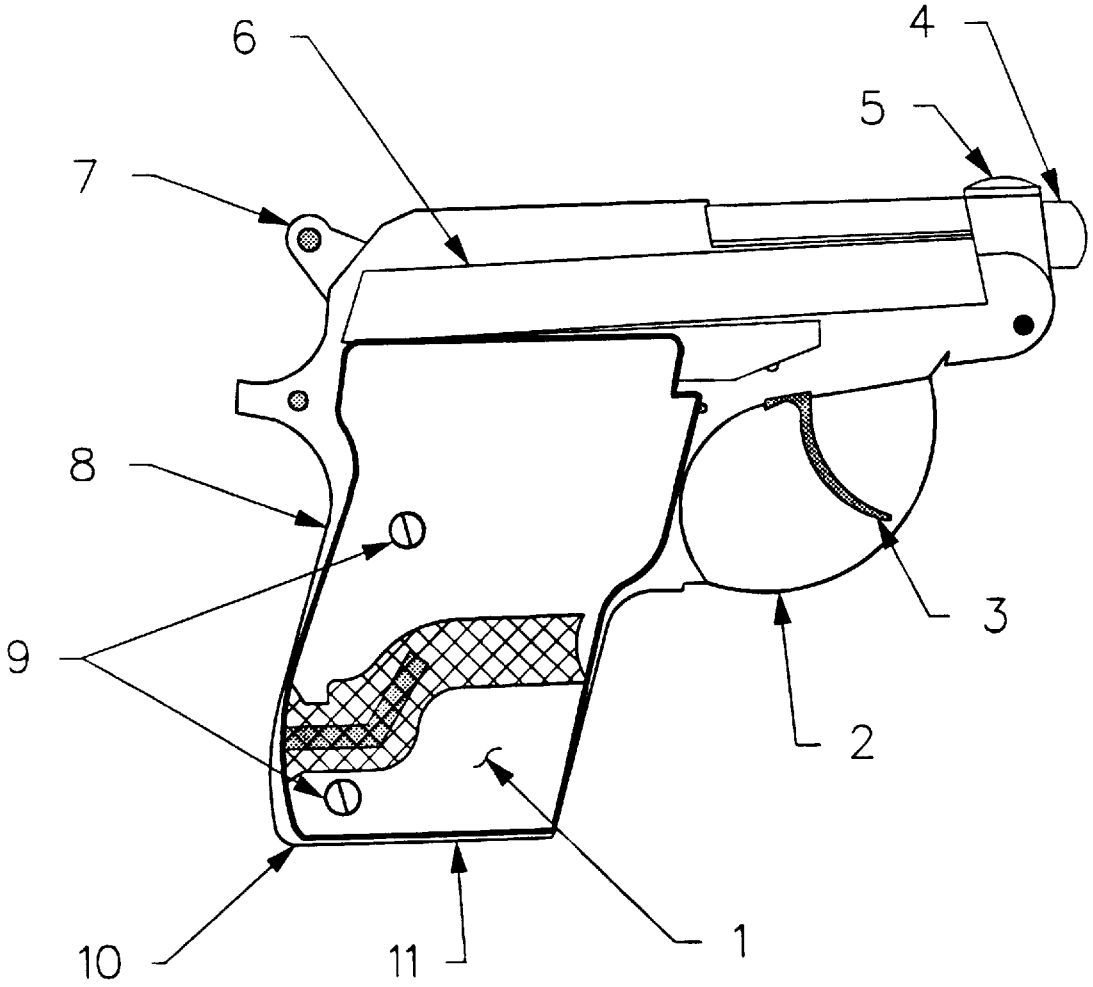
FIG. 1 is a side view of a compact semi-automatic handgun equipped with the principal object formed in accordance with the invention.
Figure 2:
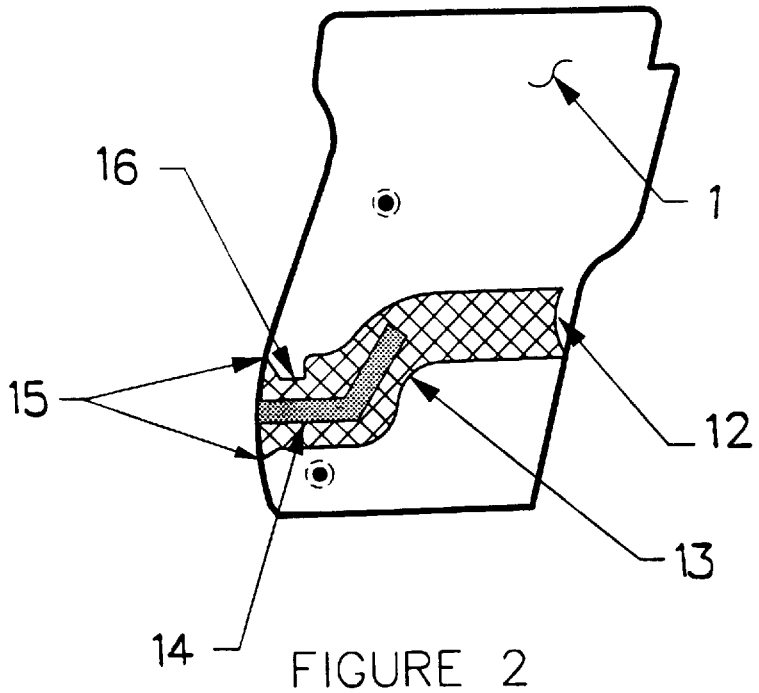
FIG. 2 is a side view of the preferred embodiment of the principal object despicted in FIG. 1.

The accompanying drawings and FIG. 1, in particular, is a disclosure of the preferred embodiment of the combination handgun grip plate appendage 1, made according to the principal object. The principal obeject includes: a unibody grip plate and an appendage fastening means, referred to as the lazy "S." The grip plate and appendage are also depicted in FIG. 2.

Figure 5:
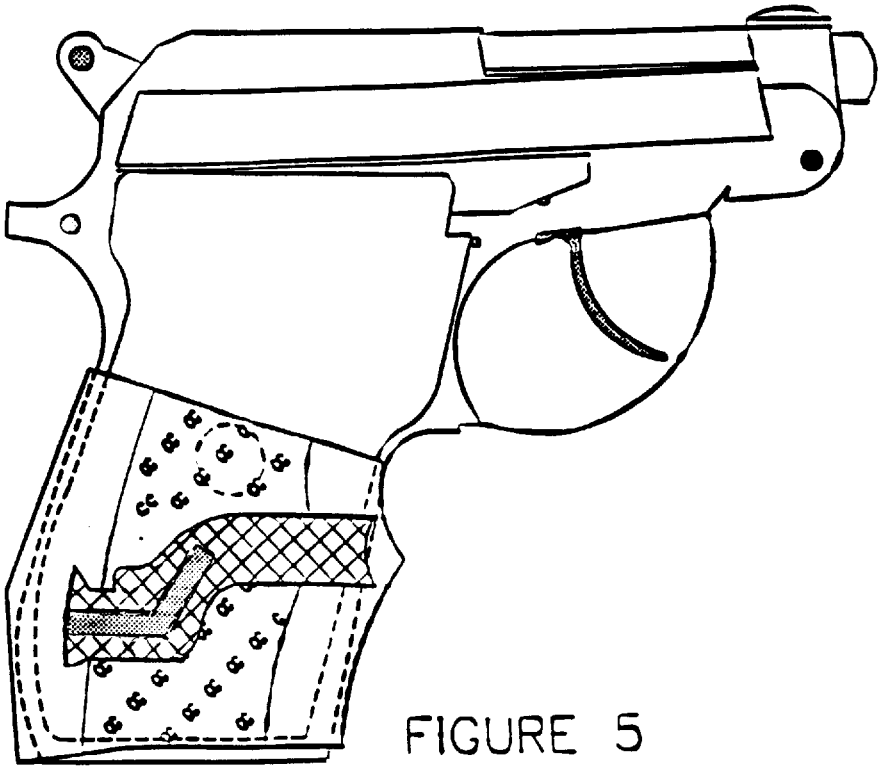
FIG. 5 is a side view of the principal object depicted as it is used with a polymer framed handgun, formed with a grip sleeve.
Figure 6:
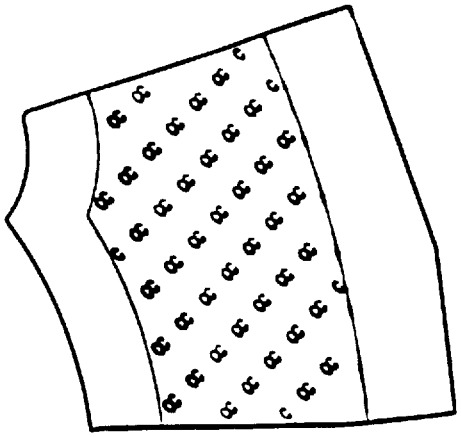
FIG. 6 is a reverse view of the grip sleeve.
Figure 6A:
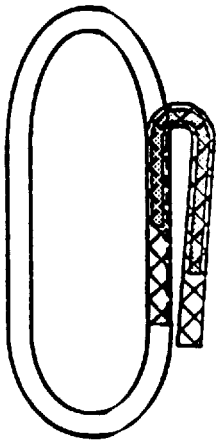
FIG. 6A is an overhead view of FIG. 6.
Figure 7:
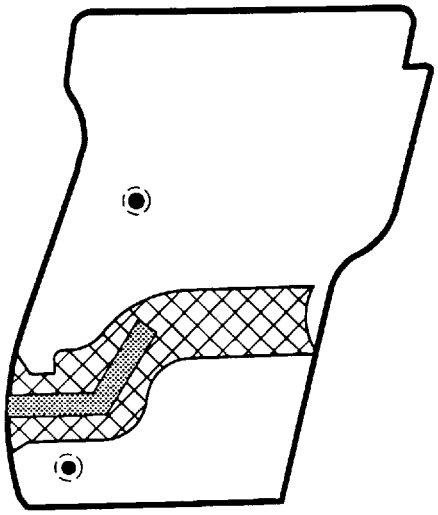
FIG. 7 is a side view of a wooden grip that has been milled and the principal object affixed to it.
Figure 7A:
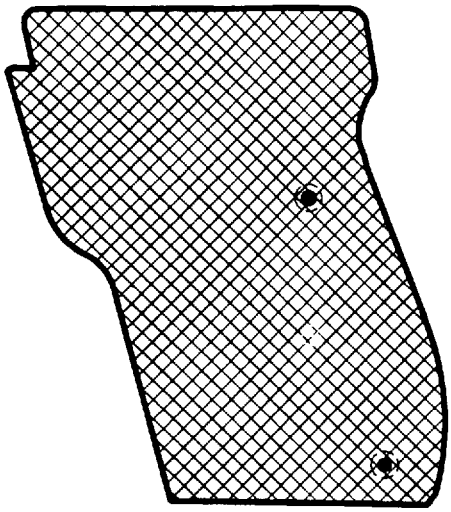
FIG. 7A is a reverse angle of FIG. 7, depicting the thermoplastic plate affixed to a wooden grip.
Figure 7B:
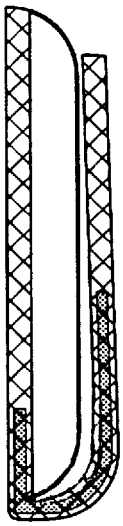
FIG. 7B is an overhead view of FIG. 7.

In the drawing, the device is shown as it would be when it is affixed to a semi-automatic handgun, FIG. 1. The handgun 11, is an existing handgun, a Beretta .25 Caliber Model 21A, and forms no part of the principal object, having: a trigger guard 2, a trigger 3, a barrel 4, sights 5, a slide 6, a hammer 7, and a handle 8. Ammunition for the handgun is placed inside of a magazine. The magazine and ammunition is then inserted into the handgun 11, via the magazine port 10, located at the bottom of the handgun. The magazine holds cartridges that are to be successively placed into the handgun chamber prior to live fire. The trigger 3, controls discharge of the handgun, when it activates the hammer 7. After a round is chambered, the hammer 7 can be cocked manually or the trigger 3, can be pulled so as to cause a discharge of the handgun. The firing of an initial live round will initiate the successive rearward movements of the slide 6, advancing additional ammunition into the chamber until the semi-automatic handgun 11 goes out of battery (runs out of ammunition). The principal object may be attached to various makes, models and types of handguns, in the same fashion, however, in the case of a polymer framed handgun (one without a removable grip plate) the principal object can be affixed to the handgun by way of a grip sleeve as is depicted in FIG. 5. Furthermore, attachment of the invention to a handgun can be accomplished in a third manner. In the third case, a wooden, thermoplastic, rubber, or composite material that has been selected by the manufacturer for the purposes of creating a factory grip, is milled (cut back). Once the factory grip has been milled, the principal object is then attached to the remaining portion of the grip. Both of the sections are combined and then attached to the handgun's handle by means of removable screw or set of screws, which are recieved into the handgun frame.

For the purposes of simplicity and clarity in this document, primary reference will be made only to the preferred means of attachment of the invention, to a handgun, as it is depicted in FIG. 1.

The handgun 11 has a wooden two piece removable handgun grip. The grip plates form a part of the handgun's handle; they are crafted to the desired shape and contour of the illustrated handgun. The manufactures grip plate, as mantioned previously, can be removed by unscrewing both of the metal screws a that are installed to securely fasten the plate to the handle.

The appendage fastening means is incorporated into the body plate and may be created by the pressure forming of thermoplastic materials including, but not limited to: Acrylic/PVC, FIG. 4. There are however, numerous other materials such as composites, metal and or wood that the principal object could be fashioned from individually or in combination thereof. The principal object, as demonstrated in FIG. 1, can be crafted to the same specifications as a factory grip plate, but with the principal objects appendage fastening means added to it. The grip plate is then received at the handle of a handgun. FIG. 2, depicts the appendage fastening means 13. The unibody grip plate and appendage fastening means contains a metal skeletal support that can be made of 41/40 hard steel 14 and has a flared base 15. The steel would prevent separation of the plate and appendage fastening means after repeated usage. The lazy "S" design, FIG. 3, is such that the device can be placed IWB and the appendage fastening means extends out from a handgun so that it can be fitted over a pair of trousers or pants and then behind a belt and belt loop rendering the handgun virtually impossible to detect with the naked eye.

The principal object, FIG. 2, is an accessory item that may be adapted to a handgun, since most handguns come from the manufacturer equipped with factory installed gips. The principal object can be used in lieu of a holster, pouch, case or a similar type of carrying device, when required and circumstances permit. The invention can be utilized when one desires complete concealment of a handgun and wishes to carry a handgun IWB. The user need only blouse a small portion of a shirt or outer garment, which has been tucked into the waistband, over the principal object and handgun, to ensure with a greater level of certainty, that the handgun will go unnoticed.

Figure 3:
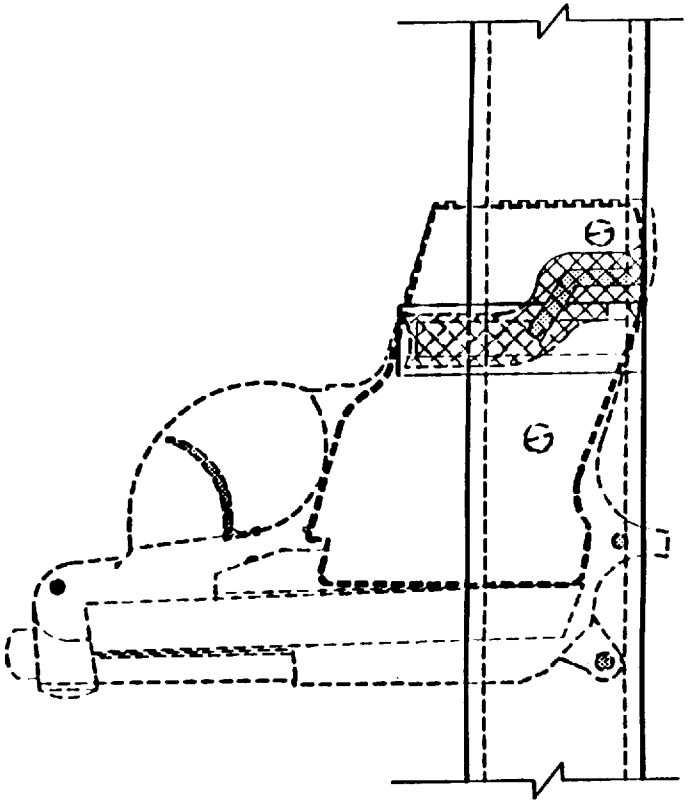
FIG. 3 is a side view of the principal object depicted in FIG. 1, showing the device in an operational position with a portion of the invention and handgun shown by dotted lines, below the waistband.
Figure 3A:
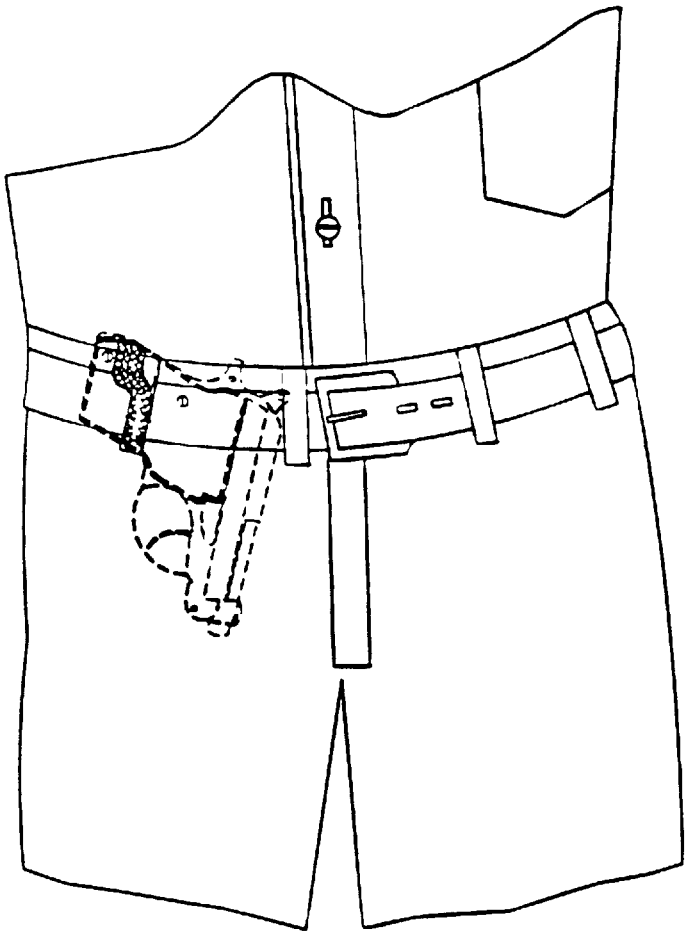
FIG. 3A is partial view of a torso with the invention and handgun positioned as it would be when it is placed inside the waistband (IWB).
Figure 4:
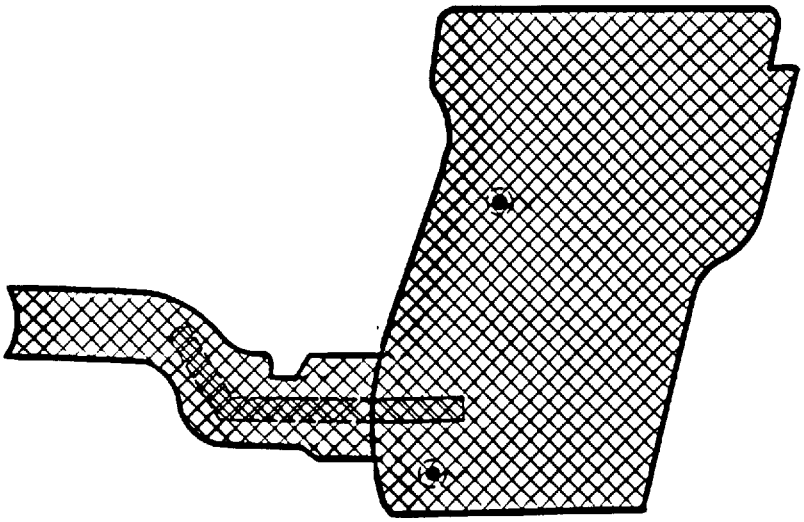
FIG. 4 is a depiction of the thermoforrned principal object.
Figure 4A:
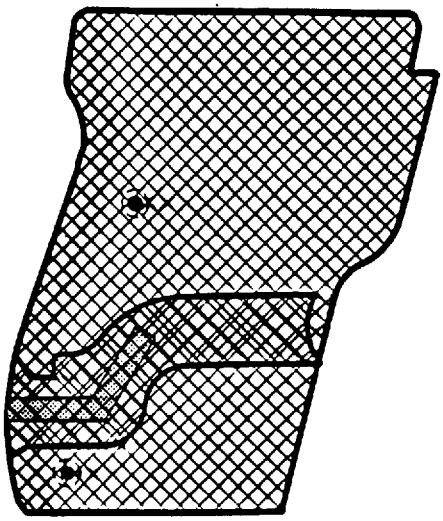
FIG. 4A is a depiction of the thermoformed principal object with the lazy "S" appendage in its operational position.
Figure 4B:
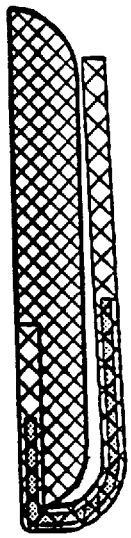
FIG. 4B is a rear view of the thermoformed principal object.

FIG. 3, depicts the principal object in operation it has been affixed to a handgun handle. The depiction also demonstrates how the lazy "S" appendage drapes over and then attaches onto earing apparel. FIG. 3A shows the handgun in actual use and how it then settles below the belt line between the torso and pants. The inner wall of the unibody grip plate rests against the user's wearing apparel. The appendage fastening means is designed to arrest the gun at the waistband. The arching extension between the unibody grip plate and appendage fastening means forces the handgun to remain securely attached at the waistline of the trouser. The notch 16 that is cut out of the lazy "S" appendage fastening means allows the user's belt loop to be received behind it. The luante (crescent) shaped end piece of the lazy "S" appendage fastening means 12 helps to stabilize the principal object directly behind a belt loop and at the lowest portion thereof, while IWB.

Since the preferential embodiment of the principal object has been duly described and depicted in detail, it should be clearly and filly apparent, to anyone skilled in the art, that any number of physical modifications and changes could be made to the aforementioned invention without altering the inventions concept and or the principal nature of its embodiment. The principal object is to be considered in all aspects as illustrative and not restrictive. The full scope of the principal object is indicated by the appended claims. All changes and or variations which may come, or happen to fall, within the scope, meaning and range of any and all equivalencies of the following claim, are to be embraced therein.

I claim:

1. A unibody, combination handgun grip plate and appendage fastening means, which is specifically designed for adaptation to mount a handgun, facilitating total weapon concealment, inside the waistband of a user's wearing apparel, completely below the belt line, secreting a handgun from view and eliminating the requirement of a holster, pouch or other potentially conspicuous carry means, comprising:

a plano-convex, parallelogram-shaped handgun grip plate conjoined to an appendage fastening means that is shaped to resemble a loosely-formed letter "S," said combination grip plate and appendage fastening means is adapted to be mounted on a handgun by mounting same to a handgun handle: wherein said appendage fastening means transversely extends across the longitudinal plane of the grip plate.

2. The object as recited in claim 1 wherein the appendage fastening means portion completes a 180 degree rotation up, out and away from a connection/union point with the grip plate portion, arching and extending to a terminal part, thereby creating a curvilinear configuration, furthermore, it achieves an "S" like form by proceeding laterally to a point where directional transition occurs, hence said appendage turns and sweeps upward to another directional transition, hence the appendage proceeds in a linear fashion to said terminal part, the terminal part coincides, when adapted to mount a handgun, with said handgun's handle at a position below the trigger guard and trigger and proximate to the magazine port.

3. The object as recited in claim 2 wherein the external surface of the arched union/connection is curved so as to avoid sharp or obtrusive angles to ensure that the appendage fastening means does not project itself harshly into the user's hand and does not interfere with one's grip when drawing, exhibiting or firing a handgun.

4. The object as recited in claim 1 wherein the appendage fastening means portion has a flared base at its connection/union to the edge of the grip plate portion, at the connection/union said appendage is at its maximum width, the appendage tapers down in width as the appendage fastening means moves laterally away from the edge of the grip plate, achieving its most narrow width at the terminal part, thereby facilitating concealment of the appendage fastening means behind the belt loop located at the waistband of a user's wearing apparel.

5. The object as recited in claim 2 wherein the appendage fastening means portion has a notch carved from t adjacent to the flared base, which, when the principal object is mounted and adapted to a handgun, is proximate to the handgun's hammer, said notch facilitates receipt and concealment of the appendage fastening means behind a portion of a belt loop located at the waistband of a user's wearing apparel.

6. The object as recited in claim 2 wherein a lunate (crescent) shaped configuration, fashioned at the terminal part of the appendage fastening means portion, pinches down on and about a specific segment of a user's belt loop material causing the appendage to remain at the rear of said belt loop, hidden from view.

7. The object as recited in claim 1 where contained within both the grip plate and appendage fastening means portions there is a single, shared, metal skeletal support facilitating flexibility and providing a deterrent to separation and/or tearing which may occur at the curvature union of said plate and appendage.

8. The object as recited in claim 1 wherein the exposed surface of the appendage fastening means, that portion which comes into contact with the user's hand or palm, is porous in nature facilitating a sure grip, said portion to be camouflaged in such a manner as to suit the user's wearing apparel, and wherein the underside of said appendage, that portion intended to be draped over a user's wearing apparel, is nonporous, flat and smooth, facilitating an unobstructed movement when the handgun is drawn, and wherein the underside of the arched union/connection between the grip plate portion and appendage fastening means portion is level, so as to prevent canting or tilting of the handgun and to ensure that said handgun handle, in its covert stationary position, is parallel to, inside and below the waistband of a user's wearing apparel when the principal object has been adapted to a handgun and said handgun is subsequently deployed for use.

* * * * *

UNITED STATES PATENT AND TRADEMARK OFFICE

CERTIFICATE OF CORRECTION

PATENT NO. : 5,881,938

DATED : March 16, 1999

INVENTOR(S) : James T. Wakefield

It is certified that error appears in the above-identified patent and that said Letters Patent is hereby corrected as shown below:

ABSTRACT, line 10, remove the ")" after the word apparel and replace it with -- , --

Column 5, line 19, remove the word "filly" and replace it with the word -- fully --

Column one, line 31, under the heading of Description of the Prior Art, remove the "s" form the word "desployed" and replace it with the word -- deployed --

Column 5, line 4, paragraph one, add the letter "w" to the word "earing" correct it to the word "wearing"

Signed and Sealed this
First Day of February, 2000

*Attest:*

*Attesting Officer*

Q. TODD DICKINSON

*Acting Commissioner of Patents and Trademarks*